US010030342B2

(12) United States Patent
Nomura et al.

(10) Patent No.: US 10,030,342 B2
(45) Date of Patent: Jul. 24, 2018

(54) IMPACT-ABSORBING LEVEE-SHAPED STRUCTURE

(71) Applicant: PROTEC ENGINEERING, INC., Niigata (JP)

(72) Inventors: Toshimitsu Nomura, Niigata (JP); Shoichi Inoue, Niigata (JP); Yoichi Nishita, Niigata (JP)

(73) Assignee: PROTEC ENGINEERING, INC., Niigata (JP)

( * ) Notice: Subject to any disclaimer, the term of this patent is extended or adjusted under 35 U.S.C. 154(b) by 0 days.

(21) Appl. No.: 15/060,552

(22) Filed: Mar. 3, 2016

(65) Prior Publication Data

US 2016/0186394 A1 Jun. 30, 2016

Related U.S. Application Data

(63) Continuation of application No. PCT/JP2013/005306, filed on Sep. 6, 2013.

(51) Int. Cl.
*E01F 7/04* (2006.01)

(52) U.S. Cl.
CPC ..... *E01F 7/04* (2013.01)

(58) Field of Classification Search
CPC . E01F 7/04; E01F 13/12; E01F 15/081; E01F 15/086; E01F 15/145; E01F 15/146; E01F 15/148; E02D 17/18; E02D 17/20; E02D 17/202; E02D 17/205; E02B 3/12; E02B 3/121; E02B 3/122; E02B 3/127
(Continued)

(56) References Cited

U.S. PATENT DOCUMENTS 3,880,404 A * 4/1975 Fitch ..... E01F 15/146 256/1
2005/0042039 A1* 2/2005 Callinan ..... E02B 3/122 405/284

(Continued)

FOREIGN PATENT DOCUMENTS

JP 2000-144644 A 5/2000
JP 2000-144645 A 5/2000

(Continued)

OTHER PUBLICATIONS

Office Action dated Jun. 14, 2016, in Japanese Patent Application No. 2015-535181, Total of 4 pages.

(Continued)

*Primary Examiner* — John J Kreck
*Assistant Examiner* — Stacy N Warren
(74) *Attorney, Agent, or Firm* — Tracy Heims; Apex Juris, pllc.

(57) ABSTRACT

An impact-absorbing levee-shaped structure consisting essentially of a resistant structure formed of reinforced embankment, the impact-absorbing levee-shaped structure includes: a continuous buffer wall of a flexible structure disposed on an impact-receiving surface of the resistant structure; and an anchor unit configured to support the continuous buffer wall, in such a manner that the continuous buffer wall cannot be separated from the resistant structure, thereby capable of preventing the continuous buffer wall from floating from the impact-receiving surface of the resistant structure upon application of impact.

4 Claims, 8 Drawing Sheets

(58) Field of Classification Search
USPC .... 405/302.4, 302.6; 256/12.5, 13.1, 24, 29; 188/266, 268; 404/6, 9, 10
See application file for complete search history.

(56) References Cited

U.S. PATENT DOCUMENTS

| | | | | |
|---|---|---|---|---|
| 2005/0262794 | A1* | 12/2005 | Derache | E01F 7/045 52/612 |
| 2011/0243670 | A1* | 10/2011 | Erez | E02D 17/20 405/284 |
| 2012/0132876 | A1* | 5/2012 | Nishita | E01F 7/04 256/12.5 |

FOREIGN PATENT DOCUMENTS

| | | | | |
|---|---|---|---|---|
| JP | 2000-144646 | A | | 5/2000 |
| JP | 2000144646 | A | * | 5/2000 |
| JP | 2003129422 | A | * | 5/2003 |
| JP | 2004-011225 | A | | 1/2004 |
| JP | 2004011224 | A | * | 1/2004 |
| JP | 2004011225 | A | * | 1/2004 |
| JP | 2008-121264 | A | | 5/2008 |
| JP | 2008121264 | A | * | 5/2008 |
| JP | 2010144447 | A | * | 7/2010 |
| JP | 2010-255200 | A | | 11/2010 |
| JP | 2011-084918 | A | | 4/2011 |
| JP | 2011084918 | A | * | 4/2011 |
| JP | 2011-153491 | A | | 8/2011 |
| JP | 2013166968 | A | * | 8/2013 |

OTHER PUBLICATIONS

International Publication WO2015/033378 with ISR, International application No. PCT/JP2013/005306, Date of the actual completion of the international search: Dec. 2, 2013.
Office Action dated Mar. 2, 2017, in Taiwanese Patent Application No. 102137886, 7 pages (with English translation).
Office Action dated Jun. 26, 2017, in Korean Patent Application No. 10-2016-7005908 (with English translation), Total of 10 pages.
Korean Office Action for Korean Patent Application No. 10-2016-7005908, dated Dec. 22, 2017, Total of 9 pages.

* cited by examiner

IMPACT-ABSORBING LEVEE-SHAPED STRUCTURE

CROSS REFERENCE TO RELATED APPLICATIONS

This is a continuation application of International Patent Application No. PCT/JP2013/005306 filed on Sep. 6, 2013 of which full contents are incorporated herein by reference.

BACKGROUND OF THE INVENTION

Field of the Invention

The present invention relates to a waiting type impact-absorbing levee-shaped structure for capturing large falling objects such as falling rocks and avalanches.

Description of the Background Art

An impact-absorbing levee-shaped structure is constructed at the foot of a mountain when an existing structure such as a road, a railroad, or a house is present near the foot of a mountain.

Various large-scale impact-absorbing levee-shaped structures that endure impact energy of 2000 kJ or higher applied in the event of falling rocks or avalanches have been proposed.

As illustrated in FIG. 9A, Patent Document 1 discloses an impact-absorbing levee-shaped structure 60 which includes a resistant structure 61 formed of an embankment levee having a trapezoidal cross-section, a plurality of impact-transmitting members 62 stacked horizontally on an impact-receiving surface of the resistant structure 61, and a plurality of impact-receiving structures 63 disposed vertically on an entire surface of the plurality of impact-transmitting members 62.

As illustrated in FIG. 9B, the impact-absorbing levee-shaped structure 60 has such a property that, when impact F applied to the impact-receiving structure 63 is transmitted to the resistant structure 61, the impact-transmitting member 62 distributes and transmits the impact to the impact-receiving surface of the resistant structure 61.
(see Patent Document 1).

PRIOR ART DOCUMENT

Patent Document

Patent Document 1: Japanese Patent Application Publication No. 2000-144644

Problems to be Solved

The impact-absorbing levee-shaped structure 60 disclosed in Patent Document 1 has the following problems.

[1] As a method of extending a transmission range of impact F on the impact-receiving surface of the resistant structure 61, a method of arranging the impact-transmitting member 62 in double or triple layers in a front-rear direction may be used.

This method incurs a problem that the size and the cost of the impact-absorbing levee-shaped structure 60 increases since the thickness of the impact-absorbing levee-shaped structure 60 increases with the number of layers of the impact-transmitting members 62.

[2] The impact-absorbing levee-shaped structure 60 is installed at the foot of a mountain to protect an existing structure such as a road, a railroad, or a house.

However, if the area of a site at the foot of a mountain, in which the impact-absorbing levee-shaped structure 60 is to be installed is smaller than the size of the impact-absorbing levee-shaped structure 60, it is not possible to install the impact-absorbing levee-shaped structure 60.

[3] As a method of reducing the installation size of the impact-absorbing levee-shaped structure 60, a method of eliminating the impact-transmitting member 62 may be used.

If the impact-transmitting member 62 is not present, the resistant structure 61 has to receive impact in a small range of the impact-receiving surface from the impact-receiving structure 63, it is necessary to manufacture the resistant structure 61 in a large size.

As a result, even if the impact-transmitting member 62 is eliminated, it is not possible to achieve a reduced size of the impact-absorbing levee-shaped structure 60.

[4] As illustrated in FIG. 9B, when impact F is applied to some impact-receiving structures 63 of the plurality of impact-receiving structures 63 arranged vertically, some of the impact-receiving structures 63 may float temporarily or the impact-receiving structure 63 may be folded or fall down.

If some of the impact-receiving structures 63 floats, since the transmission area of the impact F on the impact-transmitting member 62 from the impact-receiving structure 63 decreases, the conventional impact-receiving structure 63 cannot sufficiently perform the function of distributing and transmitting the impact F to the impact-transmitting member 62 and the resistant structure 61.

SUMMARY OF THE INVENTION

The present invention is come up with in order to solve the above problems. The object of the present invention is to provide an impact-absorbing levee-shaped structure having improved buffer performance and a small size.

Means for Solving Problems

The present invention provides an impact-absorbing levee-shaped structure consisting essentially of a resistant structure formed of reinforced embankment, the impact-absorbing levee-shaped structure including: a continuous buffer wall of a flexible structure disposed on an impact-receiving surface of the resistant structure; and an anchor unit configured to support the continuous buffer wall, in such a manner that the continuous buffer wall cannot be separated from the resistant structure, thereby capable of preventing the continuous buffer wall from floating from the impact-receiving surface of the resistant structure upon application of impact.

As another aspect of the present invention, the continuous buffer wall including a plurality of impact-receiving structures disposed vertically on the impact-receiving surface of the resistant structure is configured such that loads can be transmitted among the plurality of impact-receiving structures.

As another aspect of the present invention, for means configured such that loads can be transmitted among the plurality of impact-receiving structures, the plurality of impact-receiving structures are connected with each other through connectors to form an integrated structure; a surrounding of the plurality of impact-receiving structures is covered with a sheet-shaped or a mesh-shaped restraining member to form an integrated structure; and a surrounding of the plurality of impact-receiving structures is bound by a rope-shaped or a belt-shaped restraining member to form an integrated structure.

As another aspect of the present invention, a base end of the anchor unit is fixed to an impact-receiving structure or an intermediate position between a pair of impact-receiving structures adjacent to each other, out of the plurality of impact-receiving structures in such a manner that the continuous buffer wall cannot be separated from the resistant structure.

Advantageous Effects of the Invention

The present invention makes it is possible to improve the buffer performance of the impact-absorbing levee-shaped structure and to reduce the installation area of the impact-absorbing levee-shaped structure by the effects of a combination of the flexible continuous buffer wall in which a plurality of impact-receiving structures is integrated and the anchor unit that inhibits rebounding of the continuous buffer wall.

BRIEF DESCRIPTION OF THE DRAWINGS

For more thorough understanding of the present invention and advantages thereof, the following descriptions should be read in conjunction with the accompanying drawings, in which.

DESCRIPTION OF EMBODIMENTS OF THE INVENTION

Hereinafter, embodiments of the present invention will be described with reference to FIGS. 1-9B.

First Embodiment

[1] Outline of Impact-Absorbing Levee-Shaped Structure

Figure 1:
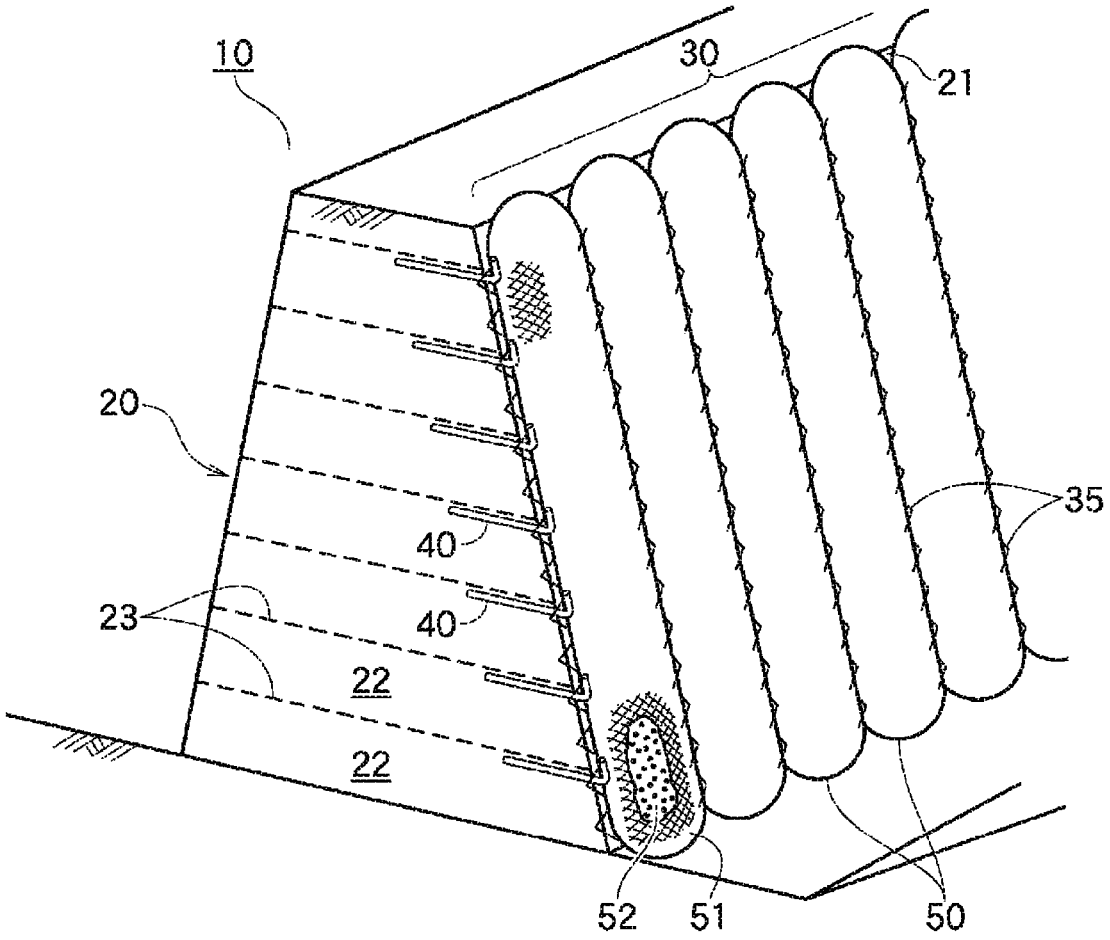
FIG. 1 depicts a diagram showing a model of an impact-absorbing levee-shaped structure as an embodiment according to the present invention, in which some components are not depicted.

When explaining with referring to FIG. 1, an impact-absorbing levee-shaped structure 10 as an embodiment according to the present invention includes a resistant structure 20 having a flexible structure, formed of a reinforced embankment, a continuous buffer wall 30 having a flexible structure, disposed on an impact-receiving surface 21 of the resistant structure 20, and an anchor unit 40 that supports the continuous buffer wall 30 so as not to be separated from the resistant structure 20.

A feature of an embodiment according to the present invention is that the size of the impact-absorbing levee-shaped structure 10 is reduced by extending an impact transmission range between the continuous buffer wall 30 and the resistant structure 20 to improve the impact-absorbing performance of the impact-absorbing levee-shaped structure 10.

[2] Resistant Structure

The resistant structure 20 is a soil clod structure that finally endures the impact of such as falling rocks, applied via the impact-receiving structure 50. The resistant structure 20 is constructed in a trapezoidal form in a cross-section by alternately performing a step of stacking a layer of embankment 22 and filling each layer with an embankment-reinforcing member 23 such as a geogrid.

An existing slope protective member (not illustrated) may be disposed on a slope side of the resistant structure 20 to protect the resistant structure 20.

The slope protective member is obtained by bending a perforated plate such as an expanded metal or a welded wire mesh in an L-shape in a cross-section, and satisfactory slope stability is obtained when one end of the embankment-reinforcing member 23 is connected to a horizontal portion of the slope protective member.

[3] Continuous Buffer Wall

The continuous buffer wall 30 includes a plurality of impact-receiving structures 50 disposed vertically on the impact-receiving surface 21 of the resistant structure 20 and is configured to transmit loads between the plurality of impact-receiving structures 50.

In the present embodiments, a structure in which the impact-receiving structures 50 adjacent to each other are connected through connectors 35 to form an integrated structure is illustrated.

[3.1] Impact-Receiving Structure

The impact-receiving structure 50 includes an oblong bag 51 and a granular impact-absorbing member 52 enclosed in the bag 51.

In embodiments according to the present invention, by integrating the plurality of impact-receiving structures 50 using the connectors 35, it is possible to impart a buffer effect and a load distribution and transmission effect to the continuous buffer wall 30.

Thus, the impact-absorbing levee-shaped structure 10 can eliminate the impact-transmitting member which is one of the conventional structural elements.

[3.1.1] Bag

The bag 51 has the impact-absorbing member 52 enclosed therein. When an impact is applied to the impact-receiving structure 50, the bag 51 absorbs the impact F by restraining the impact-absorbing member 52.

The bag 51 is formed of a material having excellent tensile strength. Examples of the material include geotextiles, aramid fibers, or high-strength wires such as steel wires.

The impact-receiving structure 50 can be produced by filling the bag 51 with the impact-absorbing member 52 through an upper opening thereof and after, closing the upper opening.

[3.1.2] Impact-Absorbing Member

Granular solids such as sand, crushed stone, or soil generated at the site, for example, can be used as the impact-absorbing member 52.

Crushed stones having a uniform size are preferably used as the impact-absorbing member 52 to improve an impact energy absorption performance.

[3.2] Connector

The connector 35 connects the plurality of impact-receiving structures 50 so that loads can be transmitted among the impact-receiving structures 50.

Figure 3A:
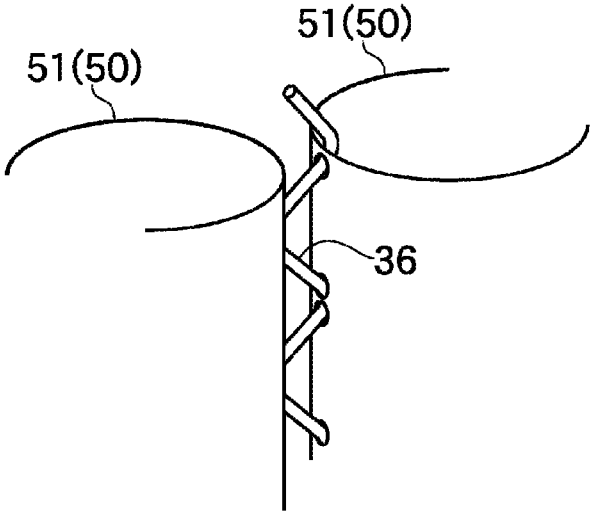
FIG. 3A depicts an explanatory diagram of a connector for impact-receiving structures.
Figure 3B:
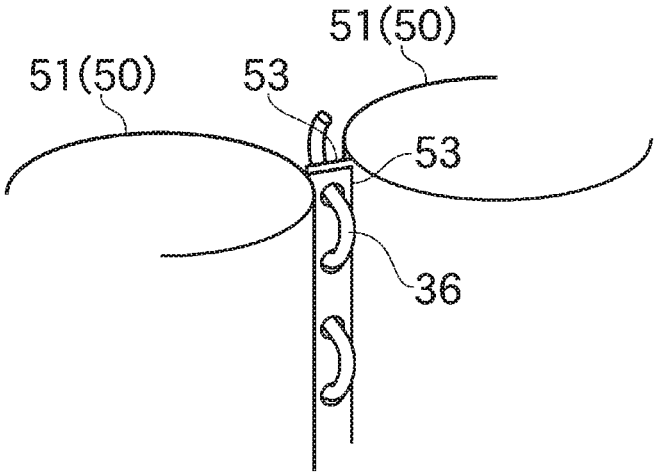
FIG. 3B depicts an explanatory diagram of another connector for impact-receiving structures.
Figure 3C:
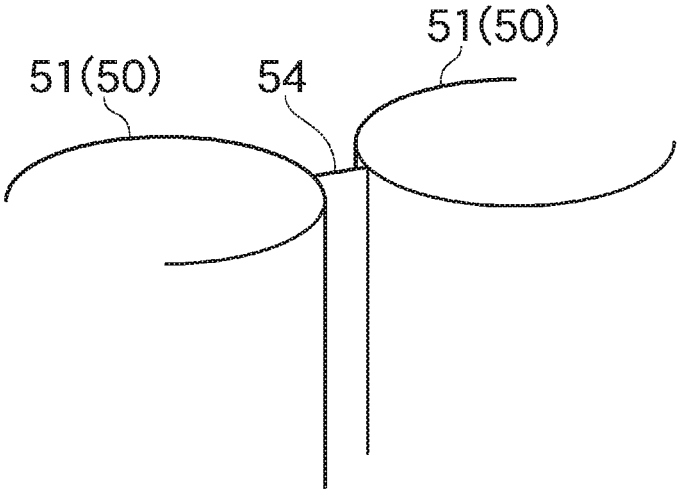
FIG. 3C depicts an explanatory diagram of another connector for impact-receiving structures.

Examples of the connector 35 for the impact-receiving structures 50 are illustrated in FIGS. 3A to 3C.

FIG. 3A illustrates an embodiment in which adjacent bags 51 and 51, are stitched together by a connecting tool 36 such as a rope, FIG. 3B illustrates an embodiment in which extension pieces 53 are provided in advance on both sides of adjacent bags 51 and 51, and the polymerized extension pieces 53 and 53 are connected through a connecting tool 36 such as a rope, and FIG. 3C illustrates an embodiment in which connection pieces 54 are formed in advance so as to be integral with the side surfaces of adjacent bags 51 and 51 and the bags 51 and 51 adjacent to each other are connected through the connection pieces 54.

The connector between the bags 51 and 51 adjacent to each other is not limited to the above-mentioned embodiments, and other existing connectors can be used.

[4] Anchor Unit

The anchor unit 40 is an anchor member for preventing the continuous buffer wall 30 from floating from the impact-receiving surface 21 of the resistant structure 20.

Existing press-fitting-type fixing pins, stables, stay anchors, and the like can be used as the anchor unit 40.

The base end of the anchor unit 40 may be fixed at an intermediate position between two impact-receiving structures 50 and 30 adjacent to each other may be fixed directly to the impact-receiving structure 50.

[Method of Constructing Impact-Absorbing Levee-Shaped Structure]

Next, a method of constructing the impact-absorbing levee-shaped structure 10 will be described with reference to FIGS. 1 and 2.

[1] Resistant Structure Construction Step

A step of laying the embankment-reinforcing member 23 horizontally and a step of laying embankment 22 on the embankment-reinforcing member 23 are repeatedly performed to construct the resistant structure 20 having a predetermined height and a predetermined length.

[2] Continuous Buffer Wall Installing Step

The continuous buffer wall 30 is installed on the inclined impact-receiving surface 21 of the resistant structure 20 close to the mountain according to the following steps.

[2.1] Installation of Impact-Receiving Structure

A plurality of impact-receiving structures 50 are arranged vertically on the impact-receiving surface 21 of the resistant structure 20.

The impact-receiving structure 50 may be installed by filling the bag 51 with the impact-absorbing member 52 at the site or may be installed by loading the impact-absorbing member 52 produced at a place other than the site and lifting the impact-absorbing member 52 using a crane or the like.

[2.2] Integration of Multiple Impact-Receiving Structures

Adjacent impact-receiving structures 50 and 50 are integrally connected using the connector 35 to form an integrated structure of the plurality of impact-receiving structures 50.

By forming the integrated structure of the plurality of impact-receiving structures 50, the flexible continuous buffer wall 30 that covers the entire surface of the impact-receiving surface 21 of the resistant structure 20 is formed.

[3] Fixing with Anchor Unit

A plurality of anchor units 40 are press-fitted at a plurality of positions of the continuous buffer wall 30 to fix the continuous buffer wall 30 to the impact-receiving surface 21 of the resistant structure 20 to complete construction of the impact-absorbing levee-shaped structure 10.

In the present embodiments, although the anchor unit 40 is provided after the continuous buffer wall 30 is installed, the anchor unit 40 may be embedded into the resistant structure 20 when the resistant structure 20 is constructed and after that the continuous buffer wall 30 may be fixed using the anchor unit 40.

[Effect of Impact-Absorbing Levee-Shaped Structure]

Next, the buffer effect when impact F is applied to the impact-absorbing levee-shaped structure 10 will be described with reference to FIGS. 2 and 4.

[1] Impact Distribution Effect of Continuous Buffer Wall

Since the plurality of impact-receiving structures 50 that forms the continuous buffer wall 30 are connected through the connector 35, loads can be transmitted between the impact-receiving structures 50 adjacent to each other.

Thus, when impact F of falling rocks is applied to a portion of the continuous buffer wall 30, the impact F is transmitted by being distributed (dispersed) in all directions of the flexible continuous buffer wall 30 having an integrated structure.

[2] Impact Absorbing Effect of Continuous Buffer Wall

The impact F distributed in all directions of the continuous buffer wall 30 is efficiently absorbed by the f effect of the plurality of impact-receiving structures 50 that form the continuous buffer wall 30.

[3] Continuous Buffer Wall Floating Prevention Effect of Anchor Unit

Figure 2:
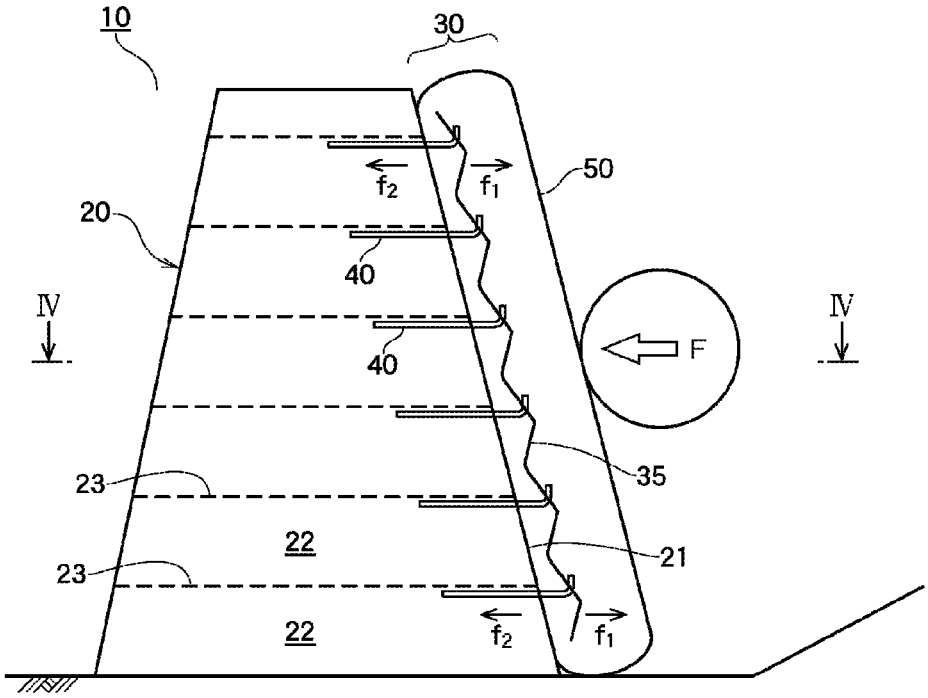
FIG. 2 depicts a cross-sectional view of the impact-absorbing levee-shaped structure.
Figure 4:
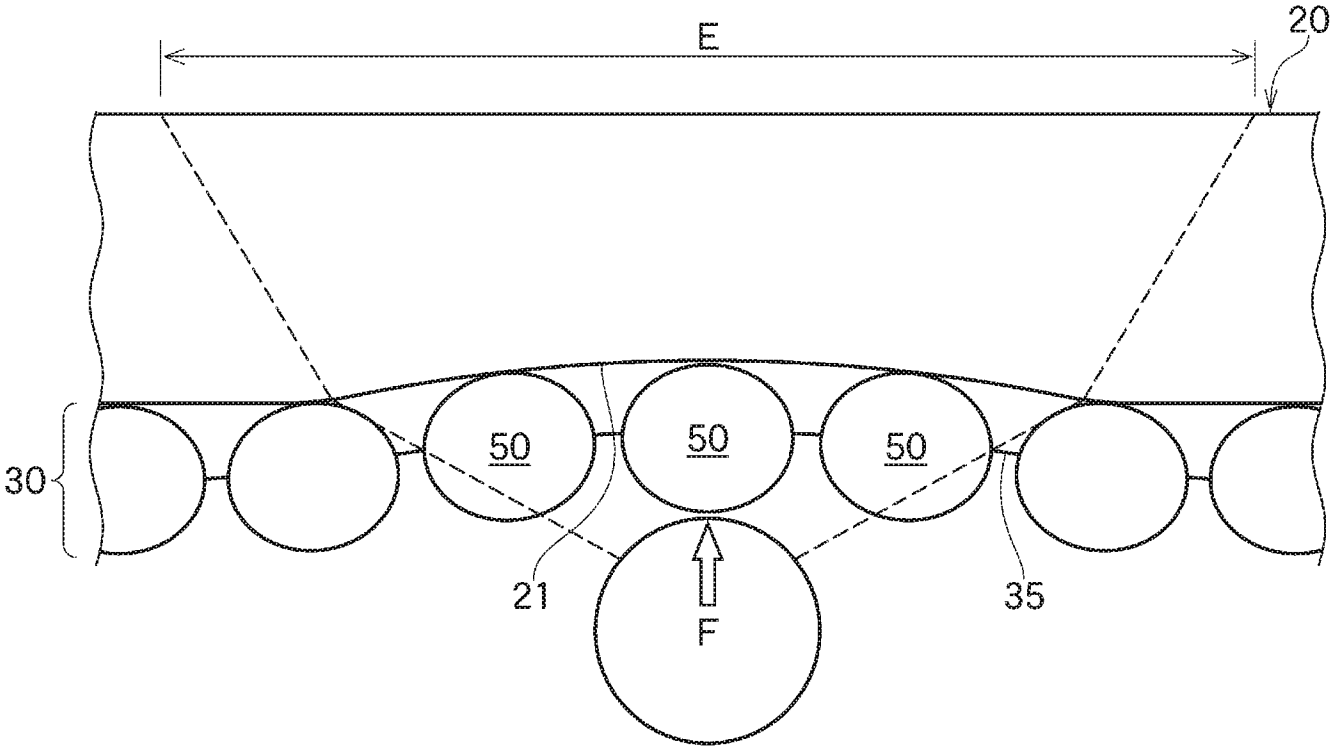
FIG. 4 depicts a cross-sectional view along line IV-IV in FIG. 2.

FIGS. 2 and 4 illustrate a state in which impact F is applied to a local area of the continuous buffer wall 30.

As illustrated in FIG. 2, when impact F is applied to a portion of the continuous buffer wall 30, floating force f1 in a direction away from the impact-receiving surface 21 is generated in a portion of the continuous buffer wall 30 to cause the continuous buffer wall 30 to rebound.

Since the continuous buffer wall 30 is fixed to the resistant structure 20 by the anchor unit 40, resisting force f2 in a direction away from the anchor unit 40 is generated in the continuous buffer wall 30.

In this manner, in an embodiment according to the present invention, since the resisting force f2 corresponding to the floating force f1 is always generated in the continuous buffer wall 30, it is possible to reliably prevent partial floating of the impact-receiving structure 50 that forms the continuous buffer wall 30 and to prevent folding of the impact-receiving structure 50.

[4] Transmission Area of Impact from Continuous Buffer Wall to Resistant Structure Since the anchor unit 40 prevents partial floating of the continuous buffer wall 30 upon application of impact, it is possible to secure a large contact area (resistant area) between the continuous buffer wall 30 and the impact-receiving surface 21 of the resistant structure 20.

That is, as illustrated in FIG. 4, since the plurality of impact-receiving structures 50 that forms the continuous buffer wall 30 have an integrated structure, the transmission range E of the impact F in the impact-receiving surface 21 of the resistant structure 20 is increased remarkably as compared to when the plurality of impact-receiving structures 50 does not have an integrated structure.

In the impact-absorbing levee-shaped structure 10 as an embodiment according to the present invention, the impact F absorbing efficiency of the resistant structure 20 is remarkably higher compared to the conventional structure.

A first reason is that the transmission area of the impact F transmitted from the continuous buffer wall 30 toward the impact-receiving surface 21 of the resistant structure 20 is extended to a large area since the plurality of impact-receiving structures 50 is disposed on the continuous buffer wall 30 having an integrated structure.

A second reason is that the transmission loss of the impact F between the continuous buffer wall 30 and the impact-receiving surface 21 of the resistant structure 20 is very small since the anchor unit 40 restrains floating of the continuous buffer wall 30.

Further, in the impact-absorbing levee-shaped structure 10 as an embodiment according to the present invention, since the impact load per unit area of the impact-receiving surface 21 is small, the resistant structure 20 itself can be designed in a small size.

In an embodiment according to the present invention, the impact-absorbing levee-shaped structure 10 is formed as a double-layer structure including the continuous buffer wall 30 having excellent performance of distributing the impact F and the resistant structure 20 having a small cross-section. Thus, the impact-absorbing levee-shaped structure 10 can be installed in a narrow site in which it is difficult to install the same according to the conventional technique.

Second Embodiment

Next, another embodiment will be described, in which the same components as those of the above-described embodiments will be denoted by the same reference numerals, and the detailed description thereof will not be provided.

Figure 5:
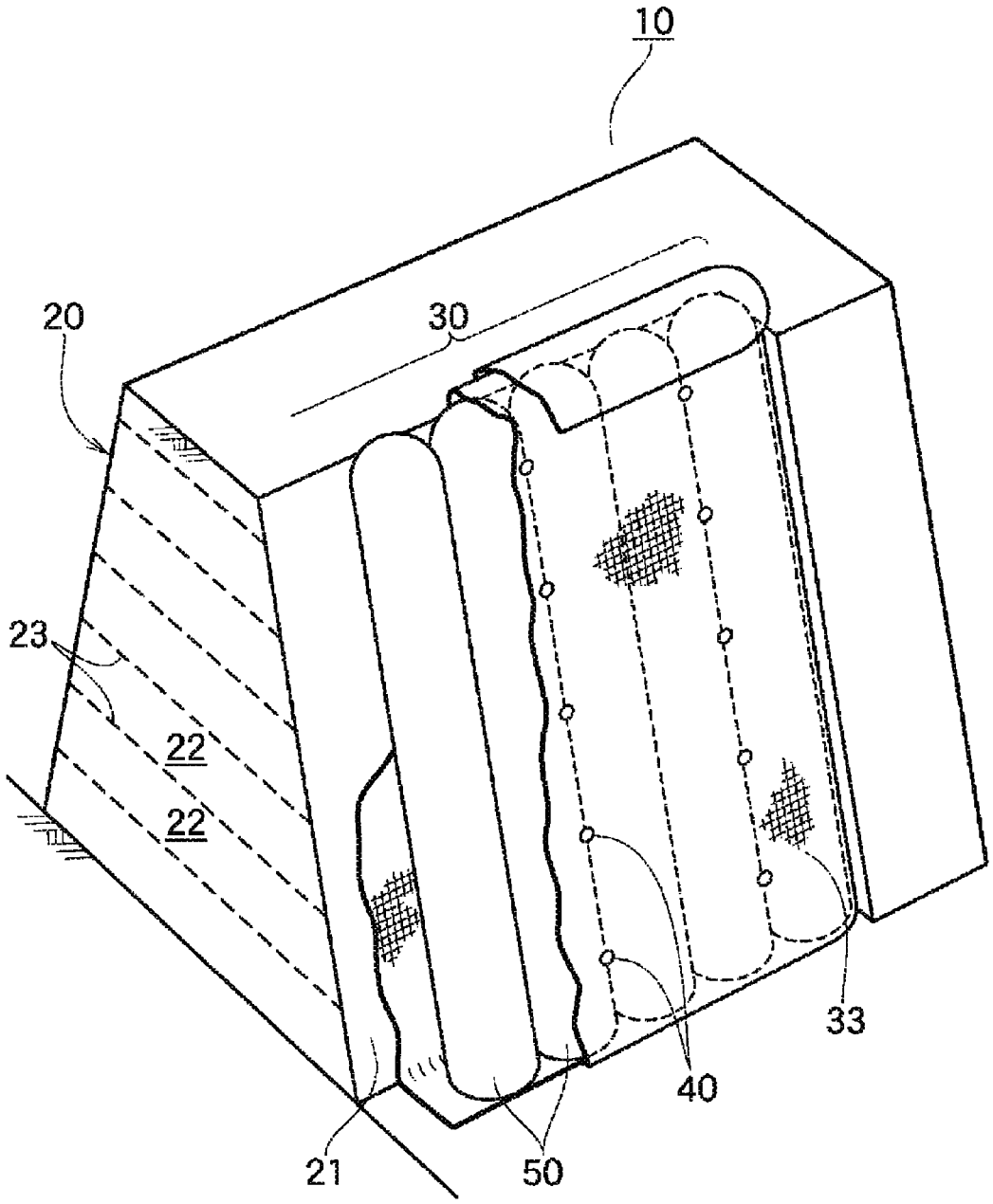
FIG. 5 depicts a diagram of a model of an impact-absorbing levee-shaped structure according to another embodiment, in which some components are not depicted.
Figure 6:
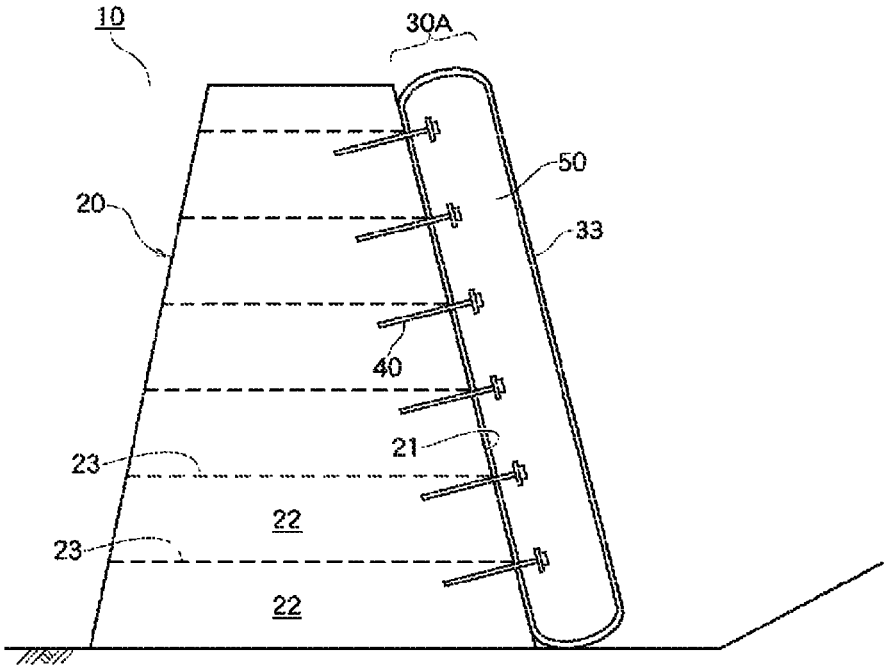
FIG. 6 depicts a cross-sectional view of the impact-absorbing levee-shaped structure.
Figure 7:
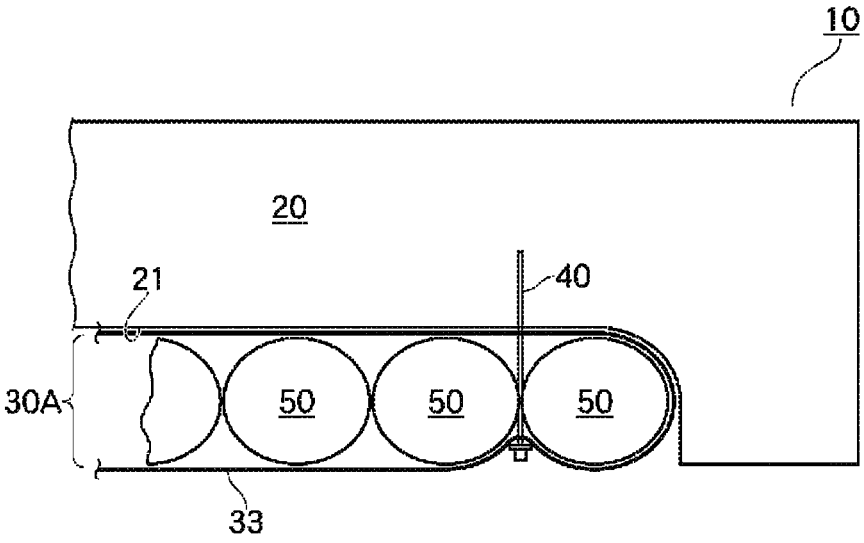
FIG. 7 depicts a horizontal cross-sectional view near an end of the impact-absorbing levee-shaped structure.

An impact-absorbing levee-shaped structure 10 including another continuous buffer wall 30A will be described with reference to FIGS. 5 to 7.

[1] Continuous Buffer Wall

The continuous buffer wall 30A of the present embodiments is obtained by covering the plurality of impact-receiving structures 50 with a sheet-shaped or a mesh-shaped restraining member 33.

[2] Restraining Member

The restraining member 33 is a sheet-shaped or a mesh-shaped non-expandable member that wraps so as to surround the plurality of impact-receiving structures 50 to thereby restrain the impact-receiving structures.

In the present embodiments, since the plurality of impact-receiving structures 50 are restrained by the sheet-shaped restraining member 33 to form an integrated structure, the connector 35 disclosed in the first embodiment can be eliminated.

Examples of a material of the sheet-shaped restraining member 33 include geotextiles, aramid fiber, and the like which have excellent weather resistance and tensile strength. Examples of a material of the mesh-shaped restraining member 33 include a wire mesh, a resin mesh such as geogrids, and the like.

[3] Anchor Unit

The effect of integrating the plurality of impact-receiving structures 50 may be insufficient just by wrapping the plurality of impact-receiving structures 50 with the restraining member 33.

In the present embodiments, since the effect of restraining the plurality of impact-receiving structures 50 can be imparted to the restraining member 33 by fixing the base ends of the plurality of anchor units 40 to the sheet-shaped or a mesh-shaped restraining member 33 that covers the plurality of impact-receiving structures 50, it is possible to integrate the plurality of impact-receiving structures 50.

That is, in the present embodiments, the anchor unit 40 performs, in cooperation with the restraining member 33, a function of restraining the plurality of impact-receiving structures 50 so that loads can be transmitted among the plurality of impact-receiving structures 50 and a function of preventing floating of the plurality of impact-receiving structures 50.

In the present embodiments, the restraining member 33 and the anchor unit 40 perform the function of the connector according to the first embodiment in cooperation.

[4] Anchor Unit Fixing Position

The base end of the anchor unit 40 is fixed to an outer side of the sheet-shaped or a mesh-shaped restraining member 33.

The base end of the anchor unit 40 is fixed to an intermediate position between a pair of impact-receiving structures 50 and 30 adjacent to each other as illustrated in the drawing or is fixed to pass through the impact-receiving structure 50.

When the anchor unit 40 is fixed to the intermediate position between the impact-receiving structures 50 and 30 adjacent to each other, the loosening of the restraining member 33 is prevented and the effect of restraining the plurality of impact-receiving structures 50 is improved.

[5] Effect of Present Embodiments

The buffer effect of the continuous buffer wall 30A and the resistant structure 20 and the effect of the anchor unit 40 preventing floating of the continuous buffer wall 30A are the same as those of the first embodiments, and the description thereof will not be provided.

In the present embodiments, by cooperation of the restraining member 33 and the connector 35, the impact applied to a portion of the continuous buffer wall 30A can be distributed in all directions.

Moreover, since the restraining member 33 that forms the continuous buffer wall 30A covers the surroundings of the plurality of impact-receiving structures 50, the impact-receiving structure 50 can be protected from ultraviolet-caused deterioration and collision with falling rocks.

Third Embodiment

Figure 8:
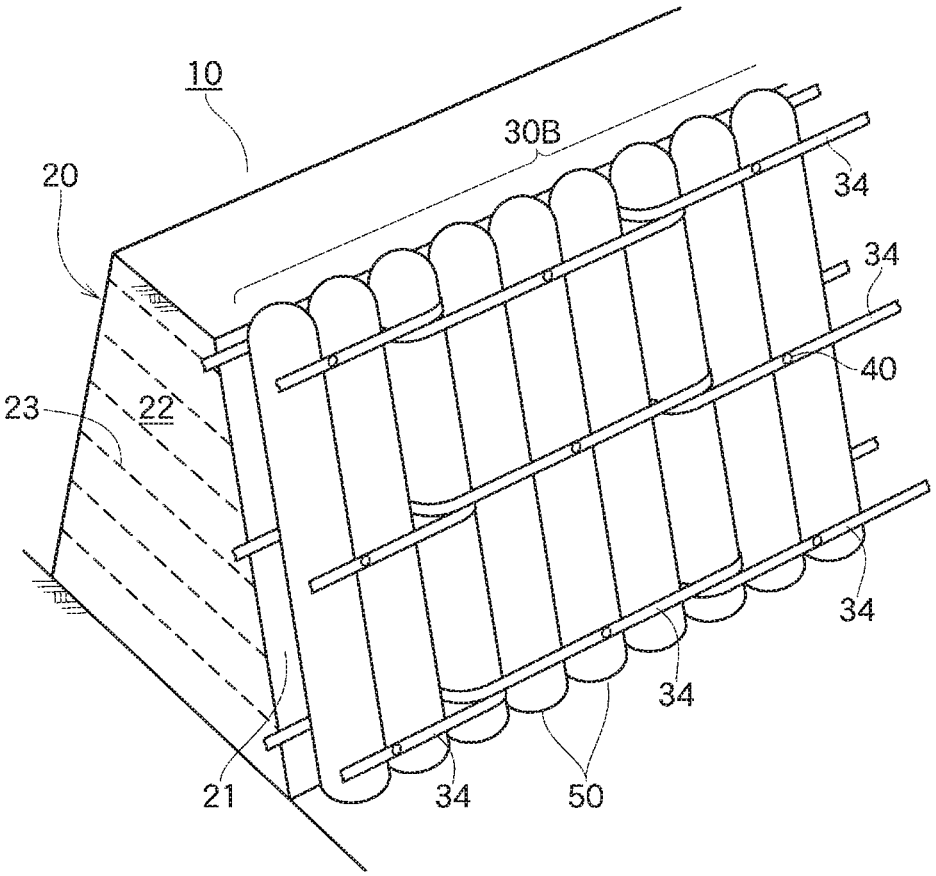
FIG. 8 depicts a diagram of a model of an impact-absorbing levee-shaped structure according to another embodiment, in which some components are not depicted.
Figure 9A:
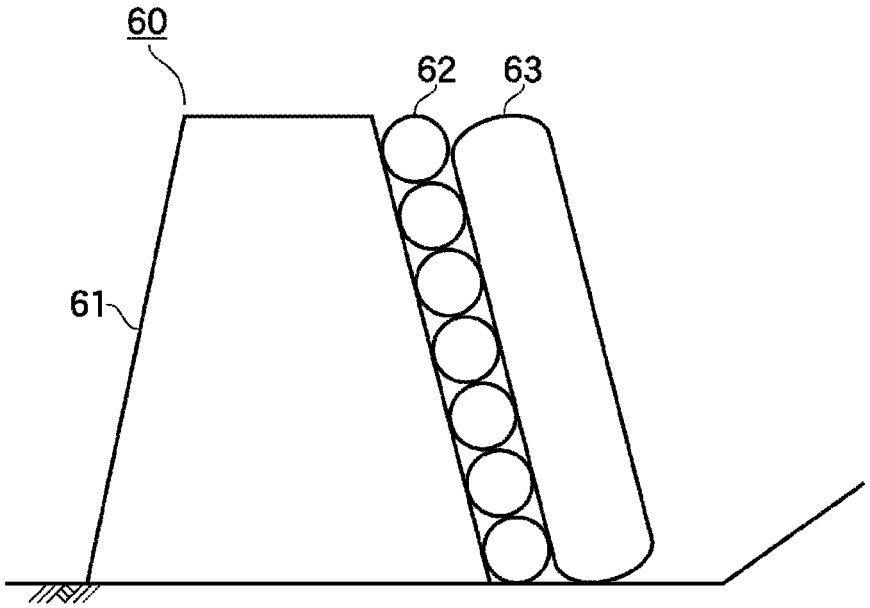
FIG. 9A depicts a diagram of a model of a conventional impact-absorbing levee-shaped structure.
Figure 9B:
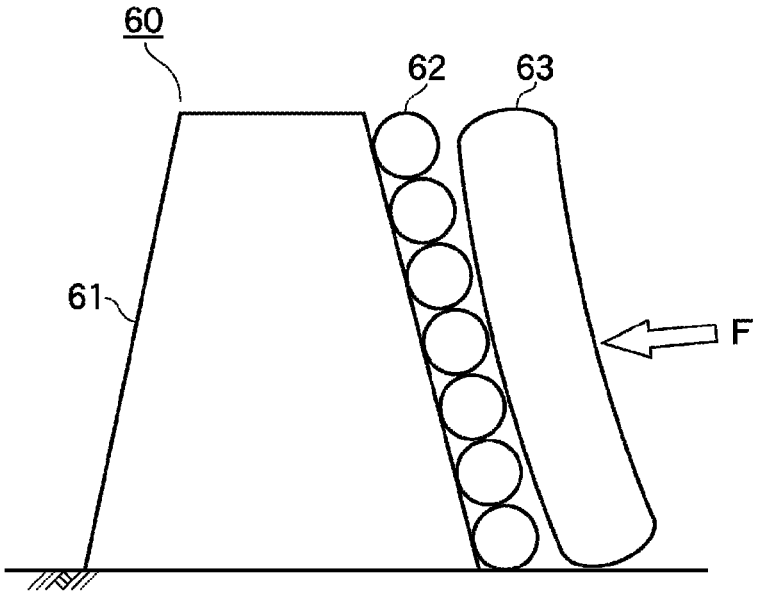
FIG. 9B depicts a diagram of a model of the conventional impact-absorbing levee-shaped structure upon application of impact.

An impact-absorbing levee-shaped structure 10 including another continuous buffer wall 30B will be described with reference to FIG. 8.

[1] Continuous Buffer Wall

The continuous buffer wall 30B of the present embodiments is obtained by binding the plurality of impact-receiving structures 50 with a rope-shaped or belt-shaped restraining member 34.

[2] Restraining Member

The restraining member 34 is a rope-shaped or belt-shaped non-expandable member which is disposed in a direction crossing the impact-receiving structure 50 so as to wrap the surroundings of the plurality of impact-receiving structures 50 in a loop form to thereby restrain the impact-receiving structures 50.

Examples of a material of the restraining member 34 include geotextiles, aramid fibers, a wire mesh, a resin mesh such as geogrids, and the like which have excellent weather resistance and tensile strength.

[3] Restraining Member Installation Form

The rope-shaped or belt-shaped restraining member 34 surrounds at least the upper, central, and lower positions of the plurality of impact-receiving structures 50 in a loop form to thereby restrain the impact-receiving structures 50.

In the present embodiments, the plurality of impact-receiving structures 50 are divided into several groups and the restraining members 34 in each group are wound in a loop form.

When the plurality of restraining members 34 are wound by sharing some impact-receiving structures 50 belonging to adjacent groups, the respective adjacent groups can be integrated.

Moreover, the restraining members 34 may be wound around all impact-receiving structures 50 together.

[4] Anchor Unit

The base end of the anchor unit 40 may be fixed to an intermediate position between two impact-receiving structures 50 and 30 or may be fixed directly to the impact-receiving structure 50.

The anchor unit 40 prevents floating of the continuous buffer wall 30B.

The function of the anchor unit 40 of the present embodiments will be described in detail. The anchor unit 40 performs, in cooperation with the restraining member 34, a function of restraining the plurality of impact-receiving structures 50 so that loads can be transmitted among the plurality of impact-receiving structures 50 that form the continuous buffer wall 30B and a function of preventing floating of the plurality of impact-receiving structures 50.

[5] Effect of Present Embodiment

The buffer effect of the continuous buffer wall 30B and the resistant structure 20 and the effect of the anchor unit 40 preventing floating of the continuous buffer wall 30B are the same as those of the first embodiment.

In the present embodiments, by cooperation of the restraining member 34 and the connector 35, the impact applied to a portion of the continuous buffer wall 30B can be distributed in all directions.

(Reference Numerals)

| | | | |
|---|---|---|---|
| 10 | Impact-absorbing levee-shaped structure | 20 | Resistant structure |
| 21 | Impact-receiving surface | 22 | Embankment |
| 23 | Embankment-reinforcing member | 30 | Continuous buffer wall |

-continued (Reference Numerals)

| | | | |
|---|---|---|---|
| 30A | Continuous buffer wall | 30B | Continuous buffer wall |
| 35 | Connector | 40 | Anchor unit |
| 50 | Impact-receiving structure | 51 | Bag |
| 52 | Impact-absorbing member | | |

What is claimed is:

1. An impact-absorbing levee structure comprising:

a double-layer structure including a resistant structure formed of reinforced embankment, and a continuous buffer wall of a flexible structure, wherein the flexible structure is a single layer and includes a plurality of impact-receiving structures, wherein each of the plurality of impact-receiving structures comprises an oblong configuration having a longitudinal axis and is arranged directly on an impact-receiving surface of the resistant structure with the longitudinal axis oriented in an upward direction substantially parallel to the impact-receiving surface, each of the plurality of impact-receiving structures being in alignment such that the longitudinal axis of each of the plurality of impact-receiving structures is substantially parallel;

an anchor unit configured to support the continuous buffer wall; in such a manner that the continuous buffer wall is not capable of being separated from the resistant structure, and is thereby capable of preventing the continuous buffer wall from floating from the impact-receiving surface of the resistant structure upon application of impact;

a plurality of connectors fastening adjacent sides of each of the plurality of impact-receiving structures to thereby transmit loads between adjacent impact receiving structures, and a non-expandable restraining member binding a selected grouping of the plurality of adjacent impact-receiving structures to thereby integrally restrain the selected grouping of the plurality of impact-receiving structures.

2. The impact-absorbing levee structure according to claim 1, wherein a base end of the anchor unit is fixed to one of the plurality of impact-receiving structures or an intermediate position between an adjacent pair of the plurality of impact-receiving structures.

3. The impact-absorbing levee structure according to claim 1, wherein a base end of the anchor unit is fixed to an intermediate position between an adjacent pair of the plurality of impact-receiving structures.

4. The impact-absorbing levee structure according to claim 1, wherein a base end of the anchor unit is fixed to one of the plurality of impact-receiving structures or an intermediate position between an adjacent pair of the plurality of impact-receiving structures.

* * * * *